US007662247B2

(12) United States Patent
Hu

(10) Patent No.: US 7,662,247 B2
(45) Date of Patent: Feb. 16, 2010

(54) METHOD OF PRODUCING MARTENSITE WEAR-RESISTANT CAST STEEL WITH FILM AUSTENITE FOR ENHANCEMENT OF TOUGHNESS

(75) Inventor: Kaihua Hu, Ningbo (CN)

(73) Assignee: Ningbo Zhedong Precision Casting Co., Ltd., Yunlong Town, Yinzhou District Ningbo, Zhejang Province (CN)

( * ) Notice: Subject to any disclaimer, the term of this patent is extended or adjusted under 35 U.S.C. 154(b) by 213 days.

(21) Appl. No.: 11/571,844

(22) PCT Filed: May 29, 2006

(86) PCT No.: PCT/CN2006/001120

§ 371 (c)(1),
(2), (4) Date: Jan. 9, 2007

(87) PCT Pub. No.: WO2006/136079

PCT Pub. Date: Dec. 28, 2006

(65) Prior Publication Data

US 2007/0231183 A1 Oct. 4, 2007

(30) Foreign Application Priority Data

Jun. 22, 2005 (CN) ..... 2005 1 0050193

(51) Int. Cl.

| | |
|---|---|
| ***C21D 9/00*** | (2006.01) |
| ***C21D 1/28*** | (2006.01) |
| ***C21C 7/076*** | (2006.01) |
| ***C22C 38/32*** | (2006.01) |
| ***C22C 38/34*** | (2006.01) |

(52) U.S. Cl. ..... 148/663; 148/664; 148/320; 148/330; 148/333; 148/526; 75/10.15; 75/10.46; 75/526

(58) Field of Classification Search ..... 148/320, 148/330, 333, 662–664, 548; 420/129, 104–111, 420/121, 126; 75/10.15, 10.46, 526
See application file for complete search history.

(56) References Cited

U.S. PATENT DOCUMENTS 5,695,576 A * 12/1997 Beguinot ..... 148/328
6,899,774 B2 * 5/2005 Takayama et al. ..... 148/336

* cited by examiner

*Primary Examiner*—Deborah Yee
(74) *Attorney, Agent, or Firm*—Global IP Services; Tianhua Gu

(57) ABSTRACT

The invention provides a Martensite wear-resistant cast steel with film Austenite for enhancement of toughness comprises 0.25~0.34 wt % C, 1.40~2.05 wt % Si, 0.90~1.20 wt % Mn, 1.80~2.50 wt % Cr, 0.0005~0.005 wt % B, 0.01~0.06 wt % Ti, 0.015~0.08 wt % Rare Earth, 0.015~0.06 wt % Al, less than 0.035 wt % S, less than 0.035 wt % P, and the balance of iron. The method of producing the cast steel includes smelting and heat-treatment, after smelting as normal operation, adding Ferro-Rare Earth and Ferro-Boron in the ladle in sequence, then high temperature normalizing, water quenching and low temperature tempering. TEM structure of the cast steel is martensite lath with film austenite between martensite laths. Cast steel of the invention exhibits high hardenability and toughness, and low cost without precious Molybdenum and Nickel, applied to a range of wear-resistant castings, especially to heavy-section castings, i.e. heavy-section tooth.

1 Claim, 1 Drawing Sheet

METHOD OF PRODUCING MARTENSITE WEAR-RESISTANT CAST STEEL WITH FILM AUSTENITE FOR ENHANCEMENT OF TOUGHNESS

FIELD OF THE INVENTION

The invention relates to the field of the wear-resistant metal material, especially wear-resistant cast steel, and concretely relates to the Martensite wear-resistant cast steel with film Austenite for enhancement of toughness, and method of production.

BACKGROUND OF THE INVENTION

Conventional wear cast steel is classified with hadfield manganese steel and low alloy cast steel. The former, being low initial hardness as a Austenite steel, can be harden when enforced by heavy impact load or contact stress, however, in 90% of actual cases, the hadfield manganese steel can not be hardened effectively and the wear-resistance is not as high as expected. The later, being heat treated to a variety of microstructure steel, have excellent wear resistance and high intensity and hardness with certain toughness, which is replacing traditional hadfield manganese steel as a new wear-resistant material. The low alloy steel is further classified with Martensite steel, Bainite steel, M/B binary phase steel and Pearlite steel, among which Martensite steel has the best wear resistance and impact resistance. The Martensite of the invention with film Austenite for enhancement of toughness is a Martensite wear-resistant cast steel. Generally, the popular sorts of Martensite wear-resistant cast steel are Cr—Mo or Cr—Mo—Ni cast steel, hackneyed specification as 30CrMo or 30CrMoNi, which are obtained by quenching and low temperature tempering, however, some problems are present as follows:

(1) insufficient hardenability. If the thickness of casting exceeds 60 mm, the centre of casting cannot be hardened completely, the impacting resistance decreases greatly because of a little α-Fe distributing in Martensite (2) insufficient toughness.

(3) high cost with the precious alloy elements Molybdenum and/or Nickel.

SUMMARY OF THE INVENTION

What is solved in the invention is, by contrast of the conventional low alloy Martensite Wear-resistant cast steel, providing a Martensite Wear-resistant Cast Steel with Film Austenite for enhancement of toughness, which exhibits high hardenability and impact resistance and can be employed to produce heavy-section wear-resistant castings.

What is solved still in the invention is providing a method of producing the Martensite Wear-resistant Cast Steel with Film Austenite for enhancement of toughness.

The solution to reach the above-mentioned objects as follows:

A Martensite wear-resistant cast steel with film austenite for enhancement of toughness comprises Fe, and basic alloying element C, Si, Mn, Cr, and microalloying element B, Ti, Rare Earth, and inevitable impurities element S, P; said cast steel comprises in detail 0.25~0.34 wt % C, 1.40~2.05 wt % Si, 0.90~1.20 wt % Mn, 1.80~2.50 wt % Cr, 0.0005~0.005 wt % B, 0.01~0.06 wt % Ti, 0.015~0.08 wt % Rare Earth, 0.015~0.06 wt % Al, less than 0.035 wt % S, less than 0.035 wt % P, and the balance of iron.

wherein said Si is 1.45 to 2.05 wt %.

wherein said Rare Earth is Cerium and Lanthanum, and the respective content is: 0.01~0.045 wt % Cerium, 0.005~0.035 wt % Lanthanum.

The method of producing the Martensite wear-resistant cast steel with film Austenite for enhancement of toughness as follows:

(1) Smelting: As normal melting operation, both electric induction furnace and electric arc furnace can be used to melting operation; when the former furnace is used, after slagging off and deoxidizing, heating the melt to about 1600~1610° C., then adding Ferro-Titanium to the electric induction furnace; Having melted and slagging off again, pouring the melt, when filling one quarter of the ladle, plunging rapidly fine Ferro-Rare Earth and Ferro-Boron particle packed with thin plastic bag into the ladle. The addition of the ferroalloys should be assured to correspond with the specification of material.

(2) Heat-treatment: firstly normalizing as holding at 1000~1050° C. for 3~4 hours, then air cooling; Secondly quenching as holding at 900~920° C. for 2~3 hours, then water cooling, finally tempering as holding at 200~230° C. for 2~3 hours, then air cooling.

The invention strengthens toughness of cast steel by addition of microalloying component Boron, Titanium and Rare Earth, and still depresses the cost greatly. The hardenability of the cast steel is further improved by rationalizing combination of cheap components Chromium, Manganese and Silicon. Thus the casting of over 100 mm thickness can be completely hardened and obtains martensite with film austenite for enhancement of toughness.

The great difference between the wear resistant cast-steel of the invention and 30CrMo steel or 30CrMoNi cast steel, that is, high content of Chromium and Silicon, and microalloying component Boron, Titanium, Rare Earth (Ce, La), which don't exist in 30CrMo or 30CrMoNi cast steel. The effect of the specific components and contents as follows:

Silicon can improve yield strength, hardenability and wear resistance in conventional cast steel, however, 1.40 to 2.05 wt % Silicon in the invention, much higher content than it in 30CrMo steel or 30CrMoNi cast steel, mainly stabilize austenite and prevent carbide precipitation to obtain martensite with film austenite between martensite laths via water quenching. The cast steel with the above-mentioned microstructure exhibits still great impacting toughness and fracture toughness besides great strength and hardness.

Chromium, which 1.80 to 2.50 wt % in the invention is higher than it in 30CrMo steel or 30CrMoNi steel, improves the hardenability and tempering resistance and makes heavy-section wear-resistant casting can be hardened to obtain martensite.

Boron, Titanium, Rare Earth (Ce, La), which don't exist in 30CrMo steel or 30CrMoNi steel and their effects as follows:

Boron, dissolving in austenite, refines substructure of martensite greatly and improves impact resistance of cast steel. The trace Boron also stabilizes austenite and improves hardenability greatly. The effect of 0.001 wt % Boron is equal to 0.3 wt % Mo.

Titanium refines grain effectively and improves strength and toughness. Titanium added before adding Boron can combine with N preferably in the melt to form TiN particle and prevents Boron brittleness caused by BN in grain boundary.

Rare Earth (Ce, La) can refine effectively as-cast microstructure, clean grain boundary, improve micrography and distribution of inclusion and increase fatigue resistance and spalling resistance. In addition, Rare Earth can still refine martensite lath and improve micrography of martensite lath, that is, the end of the lath rounds, therefore, the fracture toughness of the martensite wear cast-steel is increased.

By employing ternary components boron, Titanium and Rare Earth together, and controlling addition quantum and sequence of them, intensity and toughness of cast steel is improved, the wear resistance and service life also are prolonged.

The invention has been applied to produce excavator's bucket teeth with heavy section successfully. The process of such teeth is water-glass investment casting. When 30CrMo or 30CrMoNi cast steel is used to produce heavy-section teeth, the centre of tooth can not be hardened completely via heat-treatment, which depress the intensity and hardness and impact resistance, and causes breaking in service. Whereas, when the cast steel of the invention is employed to produce teeth as foregoing method of smelting and heat-treatment, the centre of tooth can be hardened completely, the hardness is 49-52HRC and impact value is 22.5~32.0 J/cm$^2$.

The characteristic of the invention compared with the available cast steel as follows:

1. Lower cost without precious alloy elements Molybdenum, Nickel;

2. High hardenability. The castings which the section is of over 100 mm thickness, can be hardened completely;

3. Sufficient hardness.

4. Film austenite between martensite laths for enhancement of toughness increases impact resistance to prevent breaking effectively in service.

DETAILED DESCRIPTION OF THE PREFERRED EMBODIMENTS

According to the invention, eight wear-resistant cast steel teeth with heavy-section from 60 mm to over 100 mm is produced, the testing result shows that, the centre of teeth is hardened completely, the chemical composition, hardness and impact value of them are shown in table 1.

The method of producing the aforementioned teeth as follows:

(1) smelting: electric induction furnace is used to melting operation. As normal melting process, after slagging off and deoxidizing, heating the melt temperature to about 1600~1610° C., then adding Ferro-Titanium to the electronic induction furnace; Having melted and slagging off again, pouring the melting, when filling one quarter of the ladle, plunging rapidly fine Ferro-Rare Earth and Ferro-Boron into the ladle, The addition of Ferroalloys should be assured to correspond with the specification of material.

(2) heat-treatment: firstly normalizing as holding at 1000~1050° C. for 3~4 hours, then air cooling; Secondly quenching as holding at 900~920° C. for 2~3 hours, then water cooling, finally tempering as holding at 200~230° C. for 2~3 hours, then air cooling.

TABLE 1

Chemical Composition and Mechanical Properties of Heavy-section teeth

| Part | Chemical composition (wt %) | | | | | | | | | | | Impact $a_{kv}$ | Hardness |
|---|---|---|---|---|---|---|---|---|---|---|---|---|---|
| Number | C | Si | Mn | Cr | S | P | B | Ti | Ce | La | Al | (J/cm$^2$) | HRC |
| 3452RC | 0.29 | 1.45 | 0.93 | 1.95 | 0.018 | 0.021 | 0.0032 | 0.030 | 0.031 | 0.012 | 0.023 | 23.8 | 49 |
| 6Y2553 | 0.30 | 1.60 | 0.90 | 1.99 | 0.019 | 0.025 | 0.003 | 0.030 | 0.032 | 0.010 | 0.038 | 23.0 | 52 |
| 9N4353 | 0.29 | 1.51 | 1.08 | 1.95 | 0.028 | 0.026 | 0.0039 | 0.028 | 0.028 | 0.011 | 0.042 | 32.0 | 49 |
| 9N4552 | 0.28 | 1.46 | 1.05 | 2.02 | 0.020 | 0.033 | 0.003 | 0.028 | 0.034 | 0.014 | 0.038 | 26.3 | 52 |
| 1U3352 | 0.30 | 1.70 | 1.07 | 1.97 | 0.024 | 0.029 | 0.003 | 0.027 | 0.029 | 0.016 | 0.029 | 22.5 | 52 |
| 1U3452 | 0.30 | 1.59 | 1.05 | 1.97 | 0.019 | 0.018 | 0.0038 | 0.029 | 0.031 | 0.013 | 0.025 | 27.5 | 52 |
| 9W2452ZX | 0.29 | 1.4 | 1.13 | 1.83 | 0.01 | 0.02 | 0.003 | 0.03 | 0.028 | 0.012 | 0.019 | 21 | 50.5 |
| 1U3452RC | 0.28 | 1.41 | 0.96 | 1.96 | 0.014 | 0.019 | 0.0024 | 0.03 | 0.030 | 0.013 | 0.028 | 21.5 | 50 |

As shown in table 1, heavy-section teeth exhibit sufficient hardness and excellent impact resistance, which is necessary to prevent breaking effectively in service.

Figure 1:
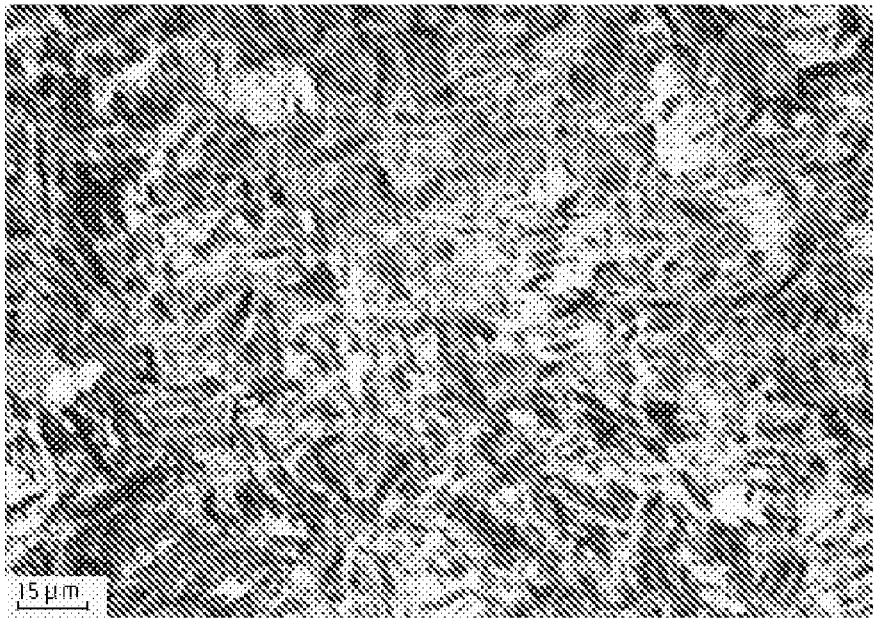
FIG. 1 is the typical photo-microstructure of heavy-section tooth.

The typical microstructure of heavy-section tooth as shown in FIG. 1 is fine and uniform martensite via low temperature tempered.

Figure 2:
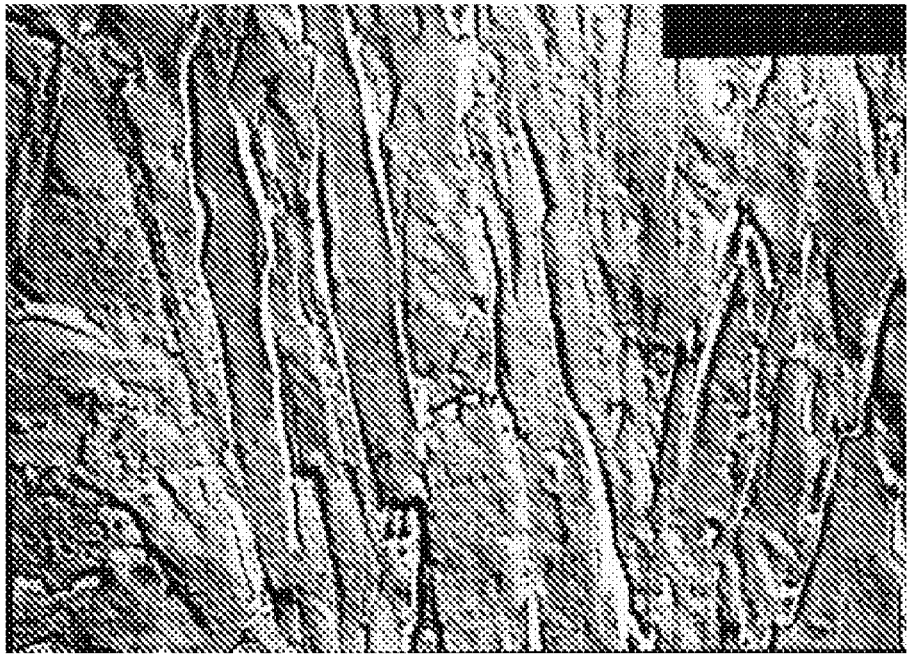
FIG. 2 is photo-TEM structure of heavy-section tooth, TEM sample is a plastic film copy from melt sample (×20000).

TEM structure shown in FIG. 2 is martensite lath, of which the thickness is around 0.1~0.3 μm and continuous retained film austenite between martensite laths, as result of stabilization of austenite and improvement of hardenability caused by Silicon and Boron. When the film austenite between martensite laths is in the high stress field where there is the end of crack, the deformation of film austenite occurs to release energy and prevent crack propagation that is raising up the critical crack propagation function. Deformation of film Austenite is helpful to increase impact resistance and fracture toughness of the material.

The invention has been applied to batch production of heavy-section teeth, which exhibit steady and excellent quality. Meanwhile, the application of the invention reduces the material cost and conserves precious natural resources, which has great economic and social effects.

What is claimed is:

1. A method of producing a Martensite wear-resistant cast steel with film austenite for enhancement of toughness as follows:

said Martensite wear-resistant cast steel with film austenite for enhancement of toughness comprising 0.25~0.34 wt % C, 1.40~2.05 wt % Si, 0.90~1.20 wt % Mn, 1.80~2.50 wt % Cr, 0.0005~0.005 wt % B 0.01~0.06 wt % Ti, 0.015~0.08 wt % Rare Earth, 0.015~0.06 wt % Al, less than 0.035 wt % S of impurity element, less than 0.035 wt % P of impurity element, and balance of iron, (1) smelting and casting comprising the following steps: heating the iron alloy in electric induction to form melt; slagging and deoxidizing melt by heating melt to about 1600~1650° C. and adding Ferro-Titanium; pouring melt into ladle, and when ladle is one quarter filled, rapidly plunging in fine Ferro-Rare Earth and Ferro-Boron particles packed in thin plastic bag into the ladle such that the addition of ferroalloys correspond with the specification of the material specification; and cooling melt to form cast steel (2) heat treatment of cast steel comprising the following steps: normalizing by heating and holding at 1000~1050° C. for 3~4 hours, air cooling, holding at 900~920° C. for 2~3 hours and water cooling; and tempering by reheating at 200~230° C. for 2~3 hours and then air cooling.

* * * * *